United States Patent [19]

Peronneau et al.

[11] Patent Number: 4,627,642

[45] Date of Patent: Dec. 9, 1986

[54] METHOD OF MARKING FOR DETERRING FRAUD WITH VALUABLE DOCUMENTS

[75] Inventors: Georges Peronneau, La Celle St Cloud; Bernard Chalus, Ollainville, both of France

[73] Assignee: Sotimag (SARL), Massy, France

[21] Appl. No.: 772,764

[22] Filed: Sep. 5, 1985

[30] Foreign Application Priority Data

Sep. 7, 1984 [FR] France ..... 84 13760

[51] Int. Cl.[4] ..... B42D 15/00

[52] U.S. Cl. ..... 283/92; 156/277; 283/94; 283/904; 427/261; 428/201; 428/204; 428/206; 428/207; 428/212; 428/690; 428/915; 428/916

[58] Field of Search ..... 156/277; 283/74, 89, 283/91, 92, 107, 108, 109, 110, 111, 112, 904, 94; 427/261; 428/201, 204, 206, 207, 212, 690, 915, 916

[56] References Cited

U.S. PATENT DOCUMENTS

| | | | |
|---|---|---|---|
| 2,984,030 | 5/1961 | Hannon | 283/109 X |
| 3,545,380 | 12/1970 | Comegys et al. | 283/904 X |
| 3,886,083 | 5/1975 | Laxer | 283/92 X |
| 4,006,050 | 2/1977 | Hurst | 283/904 X |
| 4,184,701 | 1/1980 | Franklin et al. | 428/916 |
| 4,298,217 | 11/1983 | Moraw et al. | 283/114 X |
| 4,504,083 | 3/1985 | Devrient et al. | 283/91 X |
| 4,506,915 | 3/1985 | Haghiri-Tehrani et al. | 283/904 |

*Primary Examiner*—Paul A. Bell

*Attorney, Agent, or Firm*—Kerkam, Stowell, Kondracki & Clarke

[57] ABSTRACT

The present invention relates to a method for deterring fraud with documents having monetary value such as a PVC substrate having a signature location on the substrate. In the method, a supporting ink layer 2 including a pigment and containing a product that assures it a certain porosity with respect to the substrate is deposited on the signature location; then a transparent, porous varnish layer 3 including a dissolved powder enabling a fluorescence of the desired color to be obtained under ultraviolet light is deposited on certain zones of the first ink layer 2; next a filigree pattern is printed in zones of either the first ink layer 2 or the varnish layer 3, using a silkscreening process and a second pigmented vinyl ink 4. The signature or identifying mark of the owner of the document is executed using a felt-tip pen having an indelible ink, of the type which is indelible to a product such as that sold under the mark "CORRECTOR". This method makes it possible to reveal any attempt at fraud and makes unauthorized reproductions of the documents more difficult.

19 Claims, 2 Drawing Figures

METHOD OF MARKING FOR DETERRING FRAUD WITH VALUABLE DOCUMENTS

FIELD OF THE INVENTION

The present invention relates to a method of marking documents for deterring fraud with valuable documents. The method can be used to advantage with any documents having a monetary value, such as credit cards, transit passes and the like.

BACKGROUND OF THE INVENTION

For preventing fraud with especially counterfeiting of documents having a monetary value, it is known to provide them, first, with a surface capable of accommodating the signature of the owner and, second, with a filigree or watermark pattern printed on the document, or on certain portions of the document. If the filigree pattern covers the portion having the signature, fraud becomes more difficult. If the ink in the signature is difficult to erase, the defrauder is forced to erase the filigree pattern at the same time as the signature is erased. In order to use this card again, a filigree pattern on the card must be reprinted. On the other hand, if the ink of the signature can be readily erased with a solvent, without altering the filigree pattern, then the defrauder can change the signature and use the card again. In that case, there is at present no way to tell that the card has been subjected to attempted fraud.

OBJECT AND SUMMARY OF THE INVENTION

It is accordingly the object of the invention to provide a method for overcoming the above disadvantage and for revealing any attempt at fraud, while making it more complicated to counterfeit cards.

According to the invention, the method for deterring fraud with valuable documents is applicable to documents having a PVC substrate and including a location on the substrate for a signature. The method comprises the following steps:

(1) depositing on the substrate at the signature location a first layer of ink which includes a pigment and contains a product which assures that it will have a certain amount of porosity on the signature location;

(2) depositing on certain zones of the first layer of ink a transparent, porous varnish containing in solution a powdered chelate of rare earth, making it possible to obtain a desired fluorescent color under ultraviolet light;

(3) printing a filigree pattern on some zones of the first layer of ink and of the varnish layer by a silkscreening process, using a second layer of ink, which is a pigmented vinyl ink; and (4) executing the signature of the owner of the card, using a felt-tip pen with ink that is indelible to a product such as that sold under the mark "CORRECTOR".

Further characteristics and advantages of the present invention will become more apparent from the ensuing detailed description, taken in conjunction with the drawings.

DESCRIPTION OF THE PREFERRED EMBODIMENT

Figure 1:
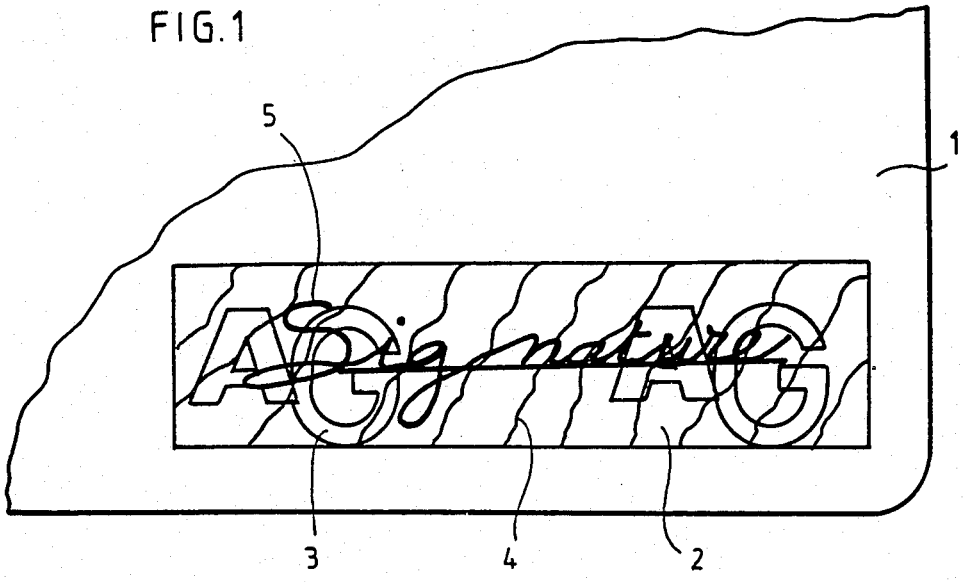
FIG. 1 is a fragmentary view of a document having monetary value.
Figure 2:
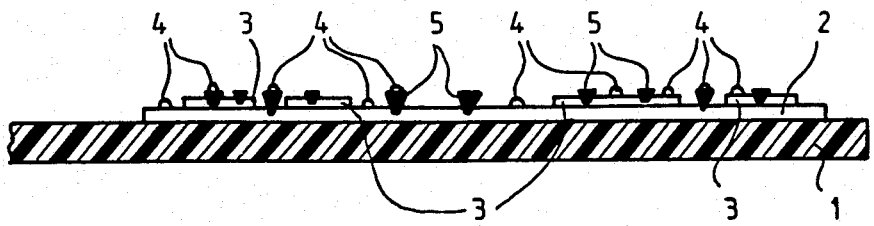
FIG. 2 is a sectional view of the various layers of this document.

FIG. 1 represents a fragmentary view of a document having monetary value, such as a credit card, obtained by the method according to the invention. This credit card comprises a substrate 1 of PVC and including a defined location which may be rectangular capable of receiving the signature of the owner. This location is provided with a first layer of ink 2 in any convenient manner. The ink 2 includes a pigment that imparts a color to it preferably white, and it contains a product that assures it will have a certain porosity with respect to the substrate. Advantageously, the ink may comprise a vinyl ink containing a dioxide of titanium. This ink is sold commercially by Dubit under the name of Blanc 1400. On selected zones of this first ink layer 2, a porous matte varnish 3 is applied, in which a powder of chelate of rare earth or of the esculin type is dissolved, so as to make this varnish fluorescent in a desired color. This fluorescence appears under ultraviolet light, but not in daylight or normal light. Varnish layer 3 may be deposited in a predetermined pattern such as, for example, the shape of initial letters, for instance, having a predetermined width and covering selected or predetermined zones of the signature location. A filigree pattern 4 is then printed in such a manner that in certain zones, the filigree is located solely on the first layer of ink and in other zones it is located on the varnish layer, as shown in FIG. 1. This filigree pattern 4 is printed by silkscreening, using a second pigmented vinyl ink layer. The transparent matte varnish comprises the varnish sold commercially by Dubit under the name Vernis Mat 1400. The product that is dissolved in the varnish is selected as a function of the desired fluorescence when the layer is placed under ultraviolet light. For instance, if a green color is desired, a chelate of terbium is used; if a yellow fluorescence is desired, a chelate of dysprosium is used; and if a blue fluorescence is desired, a product such as esculin is used. These various products advantageously have the property of not losing their fluorescence over the course of time. Then, on the location reserved for the signature, a signature 5 is executed with a felt-tip pen having an indelible ink. Ink that is indelible to a product such as that sold commercially under the mark "CORRECTOR" is advantageously sufficiently resistant to eradicators to be used. These felt-tip pens may be those sold commercially by the Staedler company and known as type 303 or those sold by the Markana company and known as type 33. Furthermore, the ink layer 2 will be selected such that its porosity with respect to the substrate is greater than that of the varnish 3. The adherence of the varnish 3 must also be less than that of the ink making up the signature, within the supporting ink layer 2.

With this method, a document such as a credit card, but certainly not limited thereto, is accordingly obtained in which may attempted fraud regarding the signature can be revealed. Since the felt-tip pen ink is indelible, the signature cannot be readily erased. Also, ink eradicators do not generally act on the supporting varnish including the fluorescent product, and cannot attack the vinyl-based silkscreening ink, since eradicators are not solvents, but act on the pigment of the ink by chemical reaction. Consequently fraud cannot be perpetrated. Conversely, in the case where the attempt is made to use a less-aggressive eradicator or solvents, such as alcohol, or where sufficient force is exerted on the ink of the signature that it is partially erased, then the ink making up the signature and deposited on the fluorescent layer will also be removed or disappear along with the fluorescent layer, but before the portions of the signature deposited on the supporting ink layer 2. This is due to the fact that on the one hand, the supporting ink layer 2 and the varnish layer have different porosities, and on the other, the felt-tip pen ink adheres to the supporting layer 2 better than the varnish adheres to the supporting ink layer. As a result, fraud can be revealed by assuring that the fluorescent portions are placed only in desired locations. The same applies if the defrauder has succeeded in replacing a signature on the card. Finally, the succession of the various steps of the method, and the association of the various products making is possible to perform these steps, makes it more difficult to counterfeit cards or documents having monetary value which are prepared in this way.

Any modification within the competance of one skilled in the art is possible without departing from the spirit and scope of the invention.

Thus it is conceivable for the filigree pattern to be printed with a non-vinyl ink which can be erased by the action of an acid-based product such as that sold under the mark "CORRECTOR", as a result of its action on the pigments in the ink. In that case, an attempt at fraud using this kind of product will be revealed by the disappearance of the filigree pattern.

What is claimed is:

1. A method for deterring fraud with documents having monetary value comprising a substrate (1) including a predetermined signature location, including the steps of:

depositing on the signature location a first supporting layer of ink (2) including a pigment having a predetermined porosity with respect to the substrate;

depositing on selected zones of the first supporting layer (2) a porous varnish layer (3), including in solution a powder enabling a fluorescence of a desired color to be obtained under ultraviolet light;

printing a filigree pattern on selected zones of the first supporting ink layer (2) and on the varnish layer (3) by silkscreening, using a second pigmented vinyl ink (4); and applying an identifying signature (5) to the card using a felt-tip pen having an indelible ink wherein the porosities of the first ink layer (2) and of the layer (3) are different, and the penetration of the vinyl ink is better on the first ink layer (2) than on the varnish layer (3); and the adherence of the indelible ink on the first ink layer (2) is better than the adherence of the varnish layer (3) on the first ink layer (2).

2. A method according to claim 1, wherein the powder is a chelate of terbium that provides a green fluorescence.

3. A card, produced in accordance with the method of claim 2.

4. A method according to claim 1, wherein the powder is a chelate of dysprosium that provides a yellow fluorescence.

5. A card, produced in accordance with the method of claim 4.

6. A method according to claim 1, wherein the powder is of the esculin type that provides a blue fluorescence.

7. A card, produced in accordance with the method of claim 6.

8. A card, produced in accordance with the method of claim 1.

9. A method according to claim 1, wherein the ink of the first layer (2) is vinyl and contains titanium dioxide.

10. A method according to claim 2, wherein the varnish (3) is transparent and matte.

11. A method according to claim 9, wherein the powder is a chelate of terbium that provides a green fluorescence.

12. A method according to claim 9, wherein the powder is a chelate of dysprosium that provides a yellow fluorescence.

13. A method according to claim 9, wherein the powder is of the esculin type that provides a blue fluorescence.

14. A card, produced in accordance with the method of claim 9.

15. A method according to claim 1, wherein the varnish (3) is transparent and matte.

16. A method according to claim 15, wherein the powder is a chelate of terbium that provides a green fluorescence.

17. A method according to claim 15, wherein the powder is a chelate of dysprosium that provides a yellow fluorescence.

18. A method according to claim 15, wherein the powder is of the esculin type that provides a blue fluorescence.

19. A card, produced in accordance with the method of claim 15.

* * * * *